US009678447B2

(12) United States Patent
Jin

(10) Patent No.: US 9,678,447 B2
(45) Date of Patent: Jun. 13, 2017

(54) TONER FOR DEVELOPING ELECTROSTATIC IMAGES AND METHOD FOR PRODUCING THE TONER

(71) Applicant: ZEON CORPORATION, Tokyo (JP)

(72) Inventor: Hiromichi Jin, Tokyo (JP)

(73) Assignee: ZEON CORPORATION, Tokyo (JP)

( * ) Notice: Subject to any disclaimer, the term of this patent is extended or adjusted under 35 U.S.C. 154(b) by 0 days.

(21) Appl. No.: 14/388,005

(22) PCT Filed: Feb. 7, 2013

(86) PCT No.: PCT/JP2013/052918

§ 371 (c)(1),
(2) Date: Sep. 25, 2014

(87) PCT Pub. No.: WO2013/145877

PCT Pub. Date: Oct. 3, 2013

(65) Prior Publication Data

US 2015/0118614 A1 Apr. 30, 2015

(30) Foreign Application Priority Data

Mar. 29, 2012 (JP) ..... 2012-076065

(51) Int. Cl.
*G03G 9/087* (2006.01)
*G03G 9/08* (2006.01)

(52) U.S. Cl.
CPC ..... *G03G 9/0806* (2013.01); *G03G 9/08706* (2013.01); *G03G 9/08708* (2013.01); *G03G 9/08711* (2013.01)

(58) Field of Classification Search
CPC . G03G 9/0806; G03G 9/0815; G03G 9/08708
See application file for complete search history.

(56) References Cited

U.S. PATENT DOCUMENTS 6,495,648 B1 * 12/2002 Inagaki ..... G03G 9/08711 428/402
2007/0048645 A1 3/2007 Takashima et al.
(Continued)

FOREIGN PATENT DOCUMENTS

JP 2000-172010 A 6/2000
JP 2004-21126 A 1/2004
(Continued)

OTHER PUBLICATIONS

International Search Report dated Mar. 26, 2013, issued in corresponding application No. PCT/JP2013/052918.

*Primary Examiner* — Peter Vajda
(74) *Attorney, Agent, or Firm* — Westerman, Hattori, Daniels & Adrian, LLP

(57) ABSTRACT

The present invention is to provide a toner which is able to prevent an odor generated from the toner upon fixing and which has excellent fixability. The present invention is also to provide a method for producing the toner. Disclosed is a method for producing a toner for developing electrostatic images, wherein a content of diethylbenzene in colored resin particles after a polymerization step and before a stripping step, is set to 100 to 400 ppm by the polymerization step; and wherein the diethylbenzene content in the colored resin particles after the stripping step is set to 30 to 250 ppm by the stripping step, and a content of the monovinyl monomer in the colored resin particles after the stripping step is set to 30 ppm or less by the stripping step.

8 Claims, 1 Drawing Sheet

(56) References Cited

U.S. PATENT DOCUMENTS

| | | | |
|---|---|---|---|
| 2009/0130578 | A1 | 5/2009 | Sensui |
| 2010/0248132 | A1 | 9/2010 | Sensui |

FOREIGN PATENT DOCUMENTS

| | | | |
|---|---|---|---|
| JP | 2007-101613 | A | 4/2007 |
| JP | 2007-232775 | A | 9/2007 |
| WO | 2007/010828 | A1 | 1/2007 |
| WO | 2009/069462 | A1 | 6/2009 |

* cited by examiner

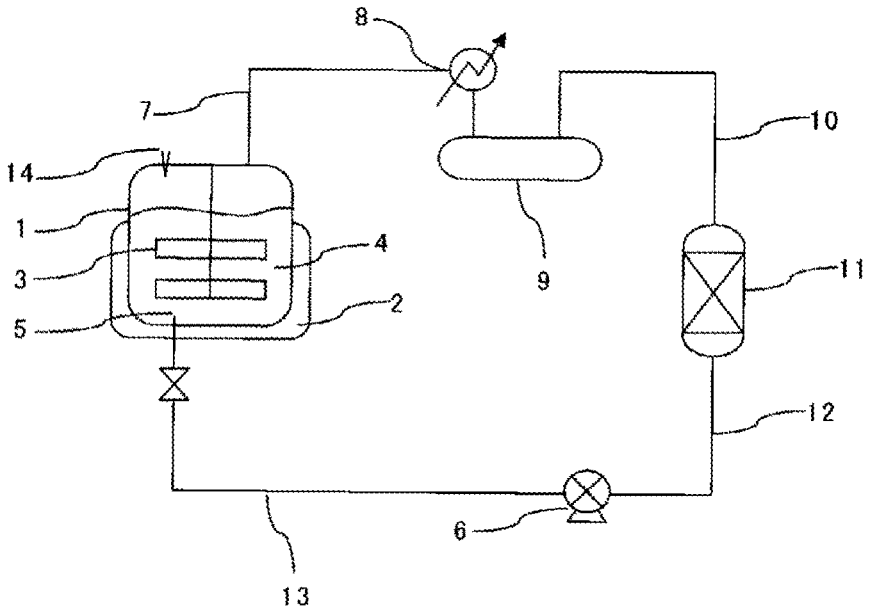
8
7
10
14
1
4
3
9
11
5
2
12
6
13

TONER FOR DEVELOPING ELECTROSTATIC IMAGES AND METHOD FOR PRODUCING THE TONER

TECHNICAL FIELD

The present invention relates to a toner for developing electrostatic images, which is configured to be used in image forming devices using electrophotography, such as a copying machine, a facsimile machine and a printer. The present invention also relates to a method for producing the toner.

BACKGROUND ART

Toners are broadly classified into pulverized toners, which are made from colored resin particles obtained by the pulverization method, and polymerized toners, which are made from colored resin particles obtained by the polymerization method.

In the pulverization method, a preliminarily-polymerized thermoplastic resin is used as a binder resin; a colorant, a charge control agent and other additives such as a release agent are added thereto; and the mixture is melted-kneaded, pulverized and then classified, thereby obtaining colored resin particles. A pulverized toner is produced by using the colored resin particles.

In the polymerization method, colored resin particles are obtained as follows: a polymerizable monomer composition containing a polymerizable monomer, a colorant and, if necessary, other additives such as a charge control agent and a release agent, is formed into minuscule droplets in an aqueous medium, followed by polymerization of the droplets, thereby obtaining colored resin particles. A polymerized toner is produced by using the colored resin particles.

In recent years, colorization of printed images has rapidly progressed in image forming devices using electrophotography, such as a copying machine and a printer. In color printing, high-resolution image printing is carried out, such as printing of pictures, so that there is a demand especially for high-resolution printing with high color reproducibility and there is also a need for high-quality color toners that can meet the demand. A spherical toner is suitable for color printing due to its high transferability and dot reproducibility. Since polymerization methods such as a suspension polymerization method, dispersion polymerization method and emulsion polymerization method can efficiently produce a spherical toner, a polymerized toner is suitable for color printing.

In recent years, environmental health regulations have been increasingly strengthened. In the field of image forming devices such as a copying machine and printer, impacts on human body and an odor of low-molecular-weight components remaining in a toner, which are components that will be volatilized when the toner is fixed by heat and include a polymerizable monomer, a decomposition product of a polymerization initiator, and other volatile organic substances, have become problems. When the low-molecular-weight components remain in large amounts in the toner, toner offset problems and toner filming problems on surfaces of members of image forming devices, such as a photosensitive member and developing blade, are likely to occur.

Therefore, methods for removing low-molecular-weight components from polymerized colored resin particles have been proposed. Due to the following reasons, it is more difficult to remove low-molecular-weight components in the polymerization method, than the case of the pulverization method. In the pulverization method, low-molecular-weight components can be removed by a heating treatment, etc., from a binder resin to be mixed with a colorant or other additive. In the polymerization method, colored resin particles are produced concurrently with polymerization; therefore, it is needed to remove low-molecular-weight components from colored resin particles in which a binder resin, which is obtained by polymerization of a polymerizable monomer, a colorant and other components co-exist. Low-molecular-weight components are easily absorbed into components other than the binder resin, such as a colorant, charge control agent and release agent. Therefore, it is more difficult to remove low-molecular-weight components from colored resin particles in the polymerization method, than the case of directly removing low-molecular-weight components from a binder resin in the pulverization method. When colored resin particles are heated for a long period of time or heated too much at high temperature for removal of low-molecular-weight components, the colored resin particles may aggregate or a colorant or other additives contained in the colored resin particles may deteriorate; therefore, the quality of a toner thus obtained is likely to be poor.

In Patent Literature 1, a method for producing a polymerized toner is disclosed, in which polymer particles are obtained by polymerizing a polymerizable monomer composition containing a colorant and a polymerizable monomer in an aqueous dispersion medium, and a stripping treatment is carried out on the polymer particles by pushing an inert gas and saturated water vapor at the same time into a dispersion containing the polymer particles.

In Patent Literature 2, a method for producing a toner for developing electrostatic images is disclosed, in which a polymerizable monomer composition containing a polymerizable monomer and a colorant is polymerized in an aqueous dispersion medium in the presence of a specific polymerization initiator to form colored resin particles, and volatile substances remaining in the colored resin particles are removed by stripping. In claims 1 and 4 of the literature, the content of styrene (a polymerizable monomer) and the content of an ether component (a decomposition product of a polymerization initiator) are mentioned.

As a result of researches made by the inventor of the present invention, it has been found that the method disclosed in Patent Literature 1 is problematic in that when stripping is carried out too much, an odor generated from the toner upon fixing, can be reduced; however, insufficient low-temperature fixability is obtained. In Patent Literature 2, experimental results on fixability are not disclosed at all.

CITATION LIST

Patent Literature 1: International Publication No. WO2009/069462

Patent Literature 2: Japanese Patent Application Laid-Open No. 2007-101613

SUMMARY OF INVENTION

Technical Problem

An object of the present invention is to provide a toner which is able to prevent an odor generated from the toner upon fixing and which has excellent fixability. Another object of the present invention is to provide a method for producing the toner.

Solution to Problem

As a result of diligent researches made to achieve the above-mentioned objects, the inventor of the present invention has found that the above-mentioned objects can be achieved by setting in a toner the amount of diethylbenzene, which is an impurity contained in divinylbenzene that is used as a polymerizable monomer, and the remaining monomer amount within specific ranges, and the above-mentioned objects can be also achieved by the toner obtained thereby.

According to the present invention, provided is a method for producing a toner for developing electrostatic images, wherein the method comprises: a polymerization step in which a polymerizable monomer composition containing at least one monovinyl monomer selected from the group consisting of styrene and a styrene derivative, at least one cross-linkable divinyl monomer selected from the group consisting of divinylbenzene and a divinylbenzene derivative, and a colorant, is polymerized in an aqueous medium in the presence of a polymerization initiator to produce colored resin particles, and a stripping step in which a volatile substance remaining in the colored resin particles is removed in the aqueous medium; wherein a content of diethylbenzene in the colored resin particles after the polymerization step and before the stripping step, is set to 100 to 400 ppm by the polymerization step; and wherein the diethylbenzene content in the colored resin particles after the stripping step is set to to 250 ppm by the stripping step, and a content of the monovinyl monomer in the colored resin particles after the stripping step is set to 30 ppm or less by the stripping step.

In the production method of the present invention, it is preferable that the polymerization initiator is a peroxy ester represented by the following formula (1), and a content of an ether component in the colored resin particles after the stripping step, which is produced by decomposition of the peroxy ester, is set to 30 ppm or less by the stripping step:

Formula (1)

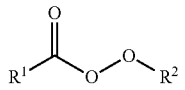

wherein $R^1$ is a secondary alkyl group having 5 or less carbon atoms, and $R^2$ is a t-butyl group or t-hexyl group.

In the production method of the present invention, the stripping step can be carried out for 4 to 8 hours, with injecting gas into an aqueous dispersion containing the colored resin particles, in the condition that a temperature of the aqueous dispersion is set to 80 to 90° C. and a pressure of a gas phase part is set to 50 to 70 kPa.

The toner for developing electrostatic images according to the present invention is a toner for developing electrostatic images, wherein the toner comprises: colored resin particles containing a binder resin that contains a styrene-based monomer unit and a divinylbenzene-based monomer unit, and a colorant, and an external additive, and a content of diethylbenzene in the colored resin particles is 30 to 250 ppm, and a content of styrene in the colored resin particles is 30 ppm or less.

In the toner for developing electrostatic images according to the present invention, it is preferable that the binder resin is a resin obtained by polymerization in the presence of a peroxy ester represented by the above formula (1), and a content of an ether component in the colored resin particles, which is produced by decomposition of the peroxy ester, is 30 ppm or less.

Advantageous Effects of Invention

According to the above-described toner production method of the present invention, which is a method for producing a toner for developing electrostatic images, a toner having excellent low-temperature fixability and containing extremely low amounts of residual low-molecular-weight components, which may be a cause of an odor generated upon printing, is provided by setting the amount of diethylbenzene after stripping and that of a monovinyl monomer after stripping within given ranges.

BRIEF DESCRIPTION OF DRAWING

FIG. 1 is a view showing an example of a system used for stripping treatment.

DESCRIPTION OF EMBODIMENTS

The method for producing a toner for developing electrostatic images according to the present invention, is a method for producing a toner for developing electrostatic images, wherein the method comprises: a polymerization step in which a polymerizable monomer composition containing at least one monovinyl monomer selected from the group consisting of styrene and a styrene derivative, at least one cross-linkable divinyl monomer selected from the group consisting of divinylbenzene and a divinylbenzene derivative, and a colorant, is polymerized in an aqueous medium in the presence of a polymerization initiator to produce colored resin particles, and a stripping step in which a volatile substance remaining in the colored resin particles is removed in the aqueous medium; wherein a content of diethylbenzene in the colored resin particles after the polymerization step and before the stripping step, is set to 100 to 400 ppm by the polymerization step; and wherein the diethylbenzene content in the colored resin particles after the stripping step is set to 30 to 250 ppm by the stripping step, and a content of the monovinyl monomer in the colored resin particles after the stripping step is set to 30 ppm or less by the stripping step.

The toner for developing electrostatic images (hereinafter may be simply referred to as "toner") produced by the production method of the present invention will be described below.

The toner obtained by the present invention contains a binder resin and a colorant. Preferably, the toner further contains an external additive.

Hereinafter, a method for producing colored resin particles used in the present invention, colored resin particles obtained by the production method, a method for producing the toner of the present invention containing the colored resin particles, and the toner obtained by the production method of the present invention, will be described in order.

1. Method for Producing Colored Resin Particles

The colored resin particles used in the present invention can be produced by a wet method. Of wet methods, a suspension polymerization method is preferred, which is carried out by the following process.

1-1. Step of Preparing a Polymerizable Monomer Composition

First, a polymerizable monomer, a colorant and, if necessary, other additive(s) such as a charge control agent, are mixed to prepare a polymerizable monomer composition. In the preparation of the polymerizable monomer composition, the mixing is conducted by, for example, a media type dispersing machine.

In the present invention, "polymerizable monomer" means a monomer having a polymerizable functional group, and the polymerizable monomer is polymerized into a binder resin. At least one monovinyl monomer selected from the group consisting of styrene and a styrene derivative is used as a main component of the polymerizable monomer. In the binder resin, the styrene and styrene derivative constitute a styrene-based monomer unit. Examples of the styrene derivative include vinyl toluene and α-methylstyrene.

In the present invention, in combination with at least one of the styrene and styrene derivative, other monovinyl monomer(s) can be used. Examples of other monovinyl monomer(s) include the following: acrylic acids and methacrylic acids; acrylic esters such as methyl acrylate, ethyl acrylate, propyl acrylate, butyl acrylate, 2-ethylhexyl acrylate and dimethylaminoethyl acrylate; methacrylic esters such as methyl methacrylate, ethyl methacrylate, propyl methacrylate, butyl methacrylate, 2-ethylhexyl methacrylate and dimethylaminoethyl methacrylate; nitrile compounds such as acrylonitrile and methacrylonitrile; amide compounds such as acrylamide and methacrylamide; and olefins such as ethylene, propylene and butylene. These monovinyl monomers can be used alone or in combination of two or more kinds. Of these monovinyl monomers, it is preferable to use at least one of an acrylic ester and a methacrylic ester, in combination with at least one of the styrene and styrene derivative. The ratio of the styrene and styrene derivative and the acrylic ester and methacrylic ester, is preferably (the styrene and styrene derivative):(the acrylic ester and methacrylic ester)=65:35 to 85:15, more preferably 70:30 to 80:20.

To prevent hot offset and improve storage stability, a cross-linkable polymerizable monomer is used in combination with the monovinyl monomer. The cross-linkable polymerizable monomer means a monomer having two or more polymerizable functional groups. As the cross-linkable polymerizable monomer, at least one cross-linkable divinyl monomer selected from the group consisting of divinylbenzene and a divinylbenzene derivative, is used. The divinylbenzene and divinylbenzene derivative constitute a divinylbenzene-based monomer unit in the binder resin. The divinylbenzene derivative used in the present invention means, for example, a compound which has a hydrocarbon group having 1 to 10 carbon atoms, etc., on the benzene ring of the divinylbenzene.

In the present invention, the cross-linkable divinyl monomer is generally used in an amount of 0.1 to 5 parts by mass, preferably 0.3 to 2 parts by mass, relative to 100 parts by mass of the monovinyl monomer.

In the present invention, in combination with at least one of the divinylbenzene and divinylbenzene derivative, other cross-linkable polymerizable monomer(s) can be used. However, it is preferable to use the divinylbenzene alone. Examples of other cross-linkable polymerizable monomers include aromatic divinyl compounds such as divinylnaphthalene and divinylnaphthalene derivatives; ester compounds such as ethylene glycol dimethacrylate and diethylene glycol dimethacrylate, in which two or more carboxylic acids having a carbon-carbon double bond are esterified to an alcohol having two or more hydroxyl groups; other divinyl compounds such as N,N-divinylaniline and divinyl ether; and compounds having three or more vinyl groups. These other cross-linkable polymerizable monomers can be used alone or in combination of two or more kinds.

In the case of using other cross-linkable polymerizable monomer(s) in combination with at least one of the divinylbenzene and divinylbenzene derivative, the total mass of the cross-linkable polymerizable monomer(s) is generally in an amount of 0.1 to 5 parts by mass, preferably 0.3 to 2 parts by mass, relative to 100 parts by mass of the monovinyl monomer.

It is preferable that the divinylbenzene used in the present invention has a relatively low purity. High-purity divinylbenzene is problematic in that it may cause polymerization during storage or it has high production cost or high selling price. In particular, preferred is divinylbenzene having a purity of 50 to 85%, and more preferred is divinylbenzene having a purity of 55 to 75%. It is also preferable that the divinylbenzene used in the present invention contains diethylbenzene in an amount of 0.1 to 7% as an impurity, and it is more preferable that the divinylbenzene used in the present invention contains diethylbenzene in an amount of 0.2 to 5%.

Commercially-available divinylbenzenes that satisfy the above conditions include, for example, DVB570 (product name; manufactured by: Nippon Steel Chemical Co., Ltd.; divinylbenzene purity: 57%; diethylbenzene content: 4.3%); DVB630 (product name; manufactured by: Nippon Steel Chemical Co., Ltd.; divinylbenzene purity: 63%; diethylbenzene content: 0.1%) and DVB810 (product name; manufactured by: Nippon Steel Chemical Co., Ltd.; divinylbenzene purity: 81%; diethylbenzene content: 0.2%).

In the present invention, the divinylbenzene purity and diethylbenzene content are on mass basis.

It is preferable to use a macromonomer further as a part of the polymerizable monomer, because the toner thus obtained has an excellent balance between storage stability and low-temperature fixability. A macromonomer is one having a polymerizable carbon-carbon unsaturated double bond at an end of a molecular chain thereof, and it is also a reactive oligomer or polymer generally having a number average molecular weight of 1,000 to 30,000. The macromonomer is preferably one that gives a polymer having a higher glass transition temperature (hereinafter may be referred to as "Tg") than that of the polymer obtained by polymerizing the above-mentioned monovinyl monomer. The macromonomer is preferably used in an amount of 0.03 to 5 parts by mass, more preferably 0.05 to 1 part by mass, relative to 100 parts by mass of the monovinyl monomer.

A colorant is used in the present invention. In the case of producing a color toner, black, cyan, yellow and magenta colorants can be used.

As the black colorant, for example, there may be used carbon black, titanium black, and magnetic powders of zinc iron oxide, nickel iron oxide and so on.

As the cyan colorant, for example, there may be used copper phthalocyanine compounds, derivatives thereof, and anthraquinone compounds. Concrete examples include C.I. Pigment Blue 2, 3, 6, 15, 15:1, 15:2, 15:3, 15:4, 16, 17:1 and 60.

As the yellow colorant, for example, there may be used compounds including condensation polycyclic pigments and azo-based pigments such as monoazo pigments, disazo pigments, etc. Examples thereof include C.I. Pigment Yellow 3, 12, 13, 14, 15, 17, 62, 65, 73, 74, 83, 93, 97, 120, 138, 155, 180, 181, 185, 186 and 213.

As the magenta colorant, there may be used compounds including condensation polycyclic pigments and azo-based pigments such as monoazo pigments, disazo pigments, etc. Examples thereof include C.I. Pigment Violet 19 and C.I. Pigment Red 31, 48, 57:1, 58, 60, 63, 64, 68, 81, 83, 87, 88, 89, 90, 112, 114, 122, 123, 144, 146, 149, 150, 163, 170, 184, 185, 187, 202, 206, 207, 209, 237, 238, 251, 254, 255 and 269.

In the present invention, colorants can be used alone or in combination of two or more kinds. The colorant is preferably used in an amount of 1 to 10 parts by mass, relative to 100 parts by mass of the monovinyl monomer.

From the viewpoint of improving the releasing characteristics of the toner from a fixing roller upon fixing, it is preferable to add a release agent to the polymerizable monomer composition. The release agent is not particularly limited as long as it is one that is generally used as a release agent in toner.

The release agent preferably contains at least one of an ester wax and a hydrocarbon wax. By using these waxes as the release agent, a suitable balance between low-temperature fixability and storage stability can be obtained.

In the present invention, preferably used as the release agent is a polyfunctional ester wax. Examples thereof include: pentaerythritol ester compounds such as pentaerythritol tetrapalmitate, pentaerythritol tetrabehenate and pentaerythritol tetrastearate; glycerin ester compounds such as hexaglycerin tetrabehenate tetrapalmitate, hexaglycerin octabehenate, pentaglycerin heptabehenate, tetraglycerin hexabehenate, triglycerin pentabehenate, diglycerin tetrabehenate, and glycerin tribehenate; and dipentaerythritol ester compounds such as dipentaerythritol hexamyristate and dipentaerythritol hexapalmitate. Of them, preferred are dipentaerythritol ester compounds, and more preferred is dipentaerythritol hexamyristate.

Also in the present invention, preferably used as the release agent is a hydrocarbon wax. Examples thereof include a polyethylene wax, a polypropylene wax, a Fischer-Tropsch wax and a petroleum wax. Of them, preferred are a Fischer-Tropsch wax and a petroleum wax, and more preferred is a petroleum wax.

The hydrocarbon wax preferably has a number average molecular weight of 300 to 800, more preferably 400 to 600. The hydrocarbon wax preferably has a penetration of 1 to 10, more preferably 2 to 7, which is measured according to JIS K2235 5.4.

Besides the above release agents, for example, there may be used a natural wax such as jojoba and a mineral wax such as ozokerite.

As the release agent, the above-mentioned waxes can be used alone or in combination of two or more kinds.

The release agent is preferably used in an amount of 0.1 to 30 parts by mass, more preferably 1 to 20 parts by mass, relative to 100 parts by mass of the monovinyl monomer.

To increase toner chargeability, a positively- or negatively-chargeable charge control agent can be used as other additive.

The charge control agent is not particularly limited, as long as it is one that is generally used as a charge control agent for toner. Among charge control agents, preferred is a positively- or negatively-chargeable charge control resin, because it has high compatibility with polymerizable monomers and is able to impart stable chargeability (charge stability) to toner particles. From the viewpoint of obtaining a positively-chargeable toner, a positively-chargeable charge control resin is more preferably used.

Examples of positively-chargeable charge control agents include the following: nigrosine dyes, quaternary ammonium salts, triaminotriphenylmethane compounds, imidazole compounds, polyamine resins (which are charge control resins preferably used), quaternary ammonium group-containing copolymers, and quaternary ammonium base-containing copolymers.

As the negatively-chargeable charge control agent, there may be mentioned azo dyes containing metals such as Cr, Co, Al, Fe, etc., salicylate metal compounds and alkyl salicylate metal compounds. Moreover, there may be mentioned sulfonic acid group-containing copolymers, sulfonic acid base-containing copolymers, carboxylic acid group-containing copolymers, carboxylic acid base-containing copolymers and so on, which are charge control resins preferably used.

In the present invention, the charge control agent is generally used in an amount of 0.01 to 10 parts by mass, preferably 0.03 to 8 parts by mass, relative to 100 parts by mass of the monovinyl monomer. When the amount of the charge control agent added is less than 0.01 part by mass, fog may be produced. When the amount of the charge control agent added is more than 10 parts by mass, soiling may occur.

It is also preferable to use a molecular weight modifier as other additive, when polymerizing the polymerizable monomer into a binder resin.

The molecular weight modifier is not particularly limited, as long as it is one that is generally used as a molecular weight modifier for toner. Examples thereof include mercaptans such as t-dodecyl mercaptan, n-dodecyl mercaptan, n-octyl mercaptan and 2,2,4,6,6-pentamethylheptane-4-thiol; and thiuram disulfides such as tetramethylthiuram disulfide, tetraethylthiuram disulfide, tetrabutylthiuram disulfide, N,N'-dimethyl-N,N'-diphenylthiuram disulfide, and N,N'-dioctadecyl-N,N'-diisopropylthiuram disulfide. These molecular weight modifiers can be used alone or in combination of two or more kinds.

In the present invention, the molecular weight modifier is generally used in an amount of 0.01 to 10 parts by mass, preferably 0.1 to 5 parts by mass, relative to 100 parts by mass of the monovinyl monomer.

1-2. Suspension Step for Obtaining a Suspension (Droplets Forming Step)

In the present invention, the polymerizable monomer composition containing at least the polymerizable monomer and the colorant is dispersed in an aqueous medium containing a dispersion stabilizer. After adding a polymerization initiator thereto, the polymerizable monomer composition is formed into droplets. The method for forming droplets is not particularly limited. For example, a machine which is capable of strong agitation is used, such as an (in-line) emulsification device (product name: MILDER; manufactured by: Ebara Corporation), a high-speed emulsification device (product name: T.K. Homo Mixer Mark II; manufactured by: PRIMIX Corporation), etc.

As the polymerization initiator, an organic peroxide is preferably used, because it can decrease polymerizable monomer residues and provide excellent printing durability. Of organic peroxides, preferred are peroxy esters, and more preferred is a peroxy ester represented by the following formula (1), because it can provide excellent polymerization initiation efficiency and decrease polymerizable monomer residues.

Formula (1)

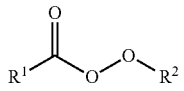

wherein $R^1$ is a secondary alkyl group having 5 or less carbon atoms, and $R^2$ is a t-butyl group or t-hexyl group.

Examples of the peroxy ester represented by the formula (1) include t-butylperoxy-2-ethylhexanoate, t-butylperoxy-2-methylbutanoate, t-butylperoxy-2-ethylbutanoate, t-butylperoxy isobutyrate, t-butyl peroxypivalate and t-hexyl peroxypivalate. Of them, preferred are t-butylperoxy-2-methylbutanoate and t-butylperoxy-2-ethylbutanoate. These examples can be used alone or in combination of two or more kinds.

Examples of the polymerization initiator further include persulfates such as potassium persulfate and ammonium persulfate, and azo compounds such as 4,4'-azobis(4-cyanovaleric acid), 2,2'-azobis(2-methyl-N-(2-hydroxyethyl) propionamide), 2,2'-azobis(2-amidinopropane)dihydrochloride, 2,2'-azobis(2,4-dimethylvaleronitrile) and 2,2'-azobisisobutyronitrile. They can be used alone or in combination of two or more kinds.

The amount of the polymerization initiator added, which is used for polymerization of the polymerizable monomer composition, is preferably 0.1 to 20 parts by mass, more preferably 0.3 to 15 parts by mass, particularly preferably 1 to 10 parts by mass, relative to 100 parts by mass of the monovinyl monomer.

As described above, the polymerization initiator can be added after dispersing the polymerizable monomer composition in the aqueous medium and before forming droplets. Or, it can be added to the polymerizable monomer composition before dispersing the composition in the aqueous medium.

In the present invention, "aqueous medium" means a medium which mainly consists of water.

In the present invention, the aqueous medium preferably contains a dispersion stabilizer. As the dispersion stabilizer, for example, there may be mentioned the following compounds: inorganic compounds including sulfates such as barium sulfate and calcium sulfate; carbonates such as barium carbonate, calcium carbonate and magnesium carbonate; phosphates such as calcium phosphate; metal oxides such as aluminum oxide and titanium oxide; and metal hydroxides such as aluminum hydroxide, magnesium hydroxide and iron(II)hydroxide; and organic compounds including water-soluble polymers such as polyvinyl alcohol, methyl cellulose and gelatin; anionic surfactants; nonionic surfactants; and ampholytic surfactants. These dispersion stabilizers can be used alone or in combination of two or more kinds.

Of the above dispersion stabilizers, preferred are inorganic compounds, and particularly preferred are colloids of hardly water-soluble metal hydroxides. By using such colloids, the particle size distribution of the colored resin particles can be adjusted to be narrow and, after washing, the amount of dispersion stabilizer residues can be decreased. Therefore, the toner thus obtained can sharply reproduce an image and shows excellent environmental stability.

1-3. Polymerization Step

Droplets are formed as described above under 1-2, and the thus-obtained aqueous dispersion medium is heated to initiate polymerization, thus producing an aqueous dispersion of the colored resin particles.

The polymerization temperature of the polymerizable monomer composition is preferably 50° C. or more, more preferably 60 to 95° C. The polymerization reaction time is preferably 1 to 20 hours, more preferably 2 to 15 hours.

The colored resin particles can be mixed with an external additive and then used as a polymerized toner. However, it is preferable to produce core-shell (or capsule) colored resin particles, by using the colored resin particles as the core layer and forming a shell layer outside the core layer. By covering the core layer, which is made of a substance having a low softening point, with a substance having a higher softening point, the core-shell colored resin particles can achieve a balance between lowering the fixation temperature and preventing aggregation during storage.

The method for producing the core-shell colored resin particles using the above-mentioned colored resin particles, is not particularly limited. The core-shell colored resin particles can be produced by conventionally-known methods. From the viewpoint of production efficiency, preferred are an in-situ polymerization method and a phase separation method.

Hereinafter, the method for producing the core-shell colored resin particles by the in-situ polymerization method, will be described.

First, a polymerizable monomer for forming the shell layer (polymerizable monomer for shell) and a polymerization initiator are added to an aqueous medium in which the colored resin particles are dispersed, and then polymerization is carried out to obtain the core-shell colored resin particles.

As the polymerizable monomer for shell, the above-mentioned polymerizable monomers can be used. Of them, it is preferable to use monomers which can provide a polymer having a Tg of more than 80° C., such as styrene, acrylonitrile and methyl methacrylate, alone or in combination of two or more kinds.

As the polymerization initiator that is used for polymerization of the polymerizable monomer for shell, for example, there may be mentioned water-soluble polymerization initiators including metal persulfates such as potassium persulfate and ammonium persulfate; and azo-based initiators such as 2,2'-azobis(2-methyl-N-(2-hydroxyethyl) propionamide) and 2,2'-azobis(2-methyl-N-(1,1-bis(hydroxymethyl)2-hydroxyethyl)propionamide). They can be used alone or in combination of two or more kinds. The polymerization initiator is preferably used in an amount of 0.1 to 30 parts by mass, more preferably 1 to 20 parts by mass, relative to 100 parts by mass of the polymerizable monomer for shell.

The polymerization temperature of the shell layer is preferably 50° C. or more, more preferably 60 to 95° C. The polymerization reaction time is preferably 1 to 20 hours, more preferably 2 to 15 hours.

A major characteristic of the present invention is that the content of diethylbenzene in the colored resin particles after the polymerization step and before the below-described stripping step, is set to 100 to 400 ppm by the polymerization step. When the diethylbenzene content is less than 100 ppm, the diethylbenzene amount is too low after the stripping, so that the low-temperature fixability of a toner thus obtained may be poor. When the diethylbenzene content is more than 400 ppm, the diethylbenzene amount remains too high even after the stripping, so that an odor generated from the toner upon fixing may not be prevented.

It is preferable to set the diethylbenzene content in the colored resin particles after the polymerization step and before the stripping step, to 130 to 370 ppm, and it is more preferable to set the same to 150 to 350 ppm.

The diethylbenzene contained in the colored resin particles after the polymerization and before the stripping, can be one in which two vinyl groups of the divinylbenzene has been turned into ethyl groups in the polymerization step. Or, it may be diethylbenzene that has been contained as an impurity in the divinylbenzene, which is a raw material, or it may be one in which the vinyl group of ethylstyrene contained in the divinylbenzene, which is a raw material, has been turned into an ethyl group.

The diethylbenzene content in the colored resin particles after the polymerization step and before the stripping step, can be controlled by appropriately determining the diethylbenzene content in the divinylbenzene used and the amount of the divinylbenzene used.

1-4. Stripping Treatment Step

After the polymerization, the aqueous dispersion of the colored resin particles is subjected to stripping treatment, for the purpose of removing volatile substances (mainly such as ether components and styrene) from the colored resin particles.

In particular, an aqueous dispersion medium containing the colored resin particles (including core-shell colored resin particles) is obtained by the polymerization step. This aqueous dispersion medium is used as it is as a dispersion containing the colored resin particles, or it is mixed with ion-exchange water, etc., to control the concentration of the colored resin particles and then used as a dispersion containing the colored resin particles. Next, this dispersion is subjected to stripping treatment to remove volatile organic components remaining in the colored resin particles, the components including unreacted polymerizable monomer. To decrease the amount of unreacted polymerizable monomer as much as possible, the stripping treatment is preferably carried out after the polymerization step is completed. As needed, the stripping treatment can be carried out at the stage which is a later stage of the polymerization reaction and where the polymerization conversion rate is preferably 90% or more, more preferably 95% or more, with continuing the polymerization reaction.

To prevent excessive foaming in the stripping treatment, a defoaming agent can be added to the dispersion. In the stripping treatment, foaming occurs on the surface of the dispersion containing the colored resin particles to produce foam. When excessive foam is produced and spills out of an evaporator, it may contaminate a gas circulation line connected to the upper side of the evaporator, may clog piping, or may require frequent cleaning.

As the defoaming agent, a silicone-based defoaming agent can be used. From the viewpoint of ease of obtaining a polymerized toner with excellent properties, it is preferable to use a non-silicone-based defoaming agent. As the non-silicone-based defoaming agent, there may be mentioned at least one kind of non-silicone-based defoaming agent selected from the group consisting of a fat and oil-based defoaming agent, a mineral oil-based defoaming agent, a polyether-based defoaming agent, a polyalkylene glycol-based nonionic surfactant, an emulsified product containing fat, oil and a polyalkylene glycol-based nonionic surfactant, and an emulsified product containing mineral oil and a polyalkylene glycol-based nonionic surfactant. Of these non-silicone-based defoaming agents, from the viewpoint of defoaming effects and toner properties, preferred are a mineral oil-based defoaming agent, a polyalkylene glycol-based nonionic surfactant, and an emulsified product containing fat, oil and a polyalkylene glycol-based nonionic surfactant.

These defoaming agents can be selected for use from commercially-available, various kinds of defoaming agents and anti-foaming agents. A mineral-oil based defoaming agent is a modified hydrocarbon oil containing mineral oil as the base, and commercially-available products thereof include a defoaming agent "DF714S" (product name) manufactured by Japan PMC Inc., for example. Polyalkylene glycol-based nonionic surfactants include a polyethylene glycol-based nonionic surfactant, a nonionic surfactant containing a polyoxyethylene-polyoxypropylene block copolymer, etc., and commercially-available products thereof include "SN Defoamer 180" (trade name; a anti-foaming agent containing a polyoxyalkylene-based nonionic surfactant; manufactured by: San Nopco Limited), for example. An emulsified product containing fat, oil and a polyalkylene glycol-based nonionic surfactant is a product obtained by emulsifying fat and oil with a polyalkylene glycol-based nonionic surfactant, and commercially-available products thereof include "SN Defoamer 1407K" (trade name; a defoaming agent containing an emulsified product of fat, oil, a polyethylene glycol-based nonionic surfactant and so on; manufactured by: San Nopco Limited), for example. Commercially-available polyether-based defoaming agents include polyether-based surfactants such as "ADEKA NOL LG-51" and "ADEKA NOL LG-109" (trade names; manufactured by: ADEKA Corporation), and special polyether-based compounds such as "IP Defoamer U-510" (trade name; manufactured by: Ipposha Oil Industries Co., Ltd.)

When a non-silicone-based defoaming agent is used as the defoaming agent, a polymerized toner having high charge amount can be obtained, without any adverse effects on the chargeability of the polymerized toner.

The solid content concentration of the aqueous dispersion containing the colored resin particles to be subjected to the stripping treatment, is preferably in a range of 5 to 45% by mass, more preferably 10 to 40% by mass, particularly preferably 15 to 35% by mass. When an aqueous dispersion having a relatively high concentration is obtained in the polymerization process, water (such as ion-exchange water) can be added to the aqueous dispersion in the stripping treatment to control the solid content concentration of the aqueous dispersion to a desired solid content concentration.

The amount of the defoaming agent (such as non-silicone-based defoaming agent) used is preferably 0.01 to 1 parts by mass, more preferably 0.05 to 0.5 parts by mass, relative to 100 parts by mass of the colored resin particles. When the amount of the defoaming agent used is too small, it may be difficult to obtain sufficient defoaming effects. When the amount is too large, defoaming effects may be saturated and toner characteristics may be adversely affected.

In the present invention, as the method for carrying out the stripping treatment on the aqueous dispersion containing the colored resin particles, a method of injecting at least any one of inert gases (such as nitrogen, argon and helium) and saturated water vapor is preferably used. It is more preferable to adopt a method of carrying out the stripping treatment under reduced pressure on the dispersion, with injecting these gases into the dispersion.

By heating the aqueous dispersion in the stripping treatment, volatilization of volatile organic components including the remaining monomer can be facilitated, and the recovery efficiency of the remaining monomer can be increased higher. In the stripping treatment, the temperature of the aqueous dispersion is preferably equal to or more than the glass transition temperature (Tg) of the resin component constituting the colored resin particles and less than 100° C., more preferably the Tg or more and 99° C. or less, still more preferably the Tg+5° C. or more and 95° C. or less. In many cases, good results can be obtained in a range of 70 to 99° C., preferably in a range of 80 to 90° C. The glass transition temperature is a value measured with a differential scanning calorimeter (DSC). When a resin component has two or more glass transition temperatures (Tg), the lowest one is used as the basis. In the stripping treatment, it is desirable to control the heating condition, at least any one of the flow rates of inert gas and saturated water vapor and so on so that the temperature of the aqueous dispersion is maintained approximately constant at a desired temperature within the above range.

Heating of the aqueous dispersion is carried out by using an evaporator (evaporation tank) furnished with a jacket for heat medium circulation, an evaporator in which a heat exchanger is installed inside, an evaporator connected to an external heat exchanger, or the like. The aqueous dispersion can be heated by injecting heated gas. When the temperature of the aqueous dispersion is too low, evaporation of the aqueous dispersion by the stripping treatment becomes insufficient. Moreover, transfer of the remaining monomer in the colored resin particles becomes slow, decreasing the rate of removal of the remaining monomer. Therefore, upon fixing, the toner thus obtained may generate a severe odor. When the temperature of the aqueous dispersion is too high, the dispersion stability of the colored resin particles is decreased. Therefore, it is possible that aggregated products may be produced during the treatment; the amount of scale attached to the wall of the evaporator or to an agitator may be increased; or the low-temperature fixability of the toner thus obtained may be poor.

The pressure of a gas phase part inside the evaporator can be appropriately determined by the specific method adopted for the stripping treatment. In general, it is preferably selected from a range of 5 to 80 kPa. In the case of adopting a method of carrying out the stripping treatment under reduced pressure with injecting a gas, the pressure inside the evaporator is preferably within a range of 50 to 70 kPa, more preferably within a range of 55 to 65 kPa. When the pressure of the gas phase part is too low, the low-temperature fixability of the toner thus obtained may be poor. On the other hand, when the pressure of the gas phase part is too high, large amounts of low-molecular-weight components remain in the colored resin particles. Therefore, upon fixing, the toner thus obtained may generate a severe odor.

The stripping treatment time varies depending on the scale of the treatment device, the treatment amount, the specific treatment method, a desired level of the content of total volatile organic compounds, etc. However, the stripping treatment time is generally selected from the range of 4 to 8 hours, preferably 5 to 7 hours. When the stripping treatment time is too long, the low-temperature fixability of the toner thus obtained may be poor. On the other hand, when the stripping treatment time is too short, large amounts of low-molecular-weight components remain in the colored resin particles. Therefore, upon fixing, the toner thus obtained may generate a severe odor.

It is preferable that an agitator is installed inside the evaporator and the stripping treatment is carried out with agitating the aqueous dispersion. The agitator is not particularly limited. Preferred is one furnished with agitating blades such as wide paddle blades, wide pitched blades, Bull margin blades and variations thereof, full zone blades or wall wetter blades. Part of each agitating blade can be projected outward from a liquid surface. In the stripping treatment step, the agitating condition is preferably that the rotational frequency of the agitating blades is 1 to 50 times per minute, more preferably 2 to 40 times per minute.

By the stripping treatment, part of the aqueous dispersion medium in the aqueous dispersion, the remaining monomer contained in the aqueous dispersion, the remaining monomer in the colored resin particles, other volatile compounds and so on are removed. The aqueous dispersion inside the evaporator may be concentrated by the stripping treatment. In this case, as needed, a new aqueous dispersion medium can be added to replenish the evaporated aqueous dispersion medium.

In the stripping treatment step, it is preferable to control the temperature of the inert gas injected into the aqueous dispersion within a range of 50 to 100° C. It is more preferable to control the inert gas temperature within a range of 60 to 95° C., still more preferably 70 to 90° C. The inert gas can be heated by heating a source or line of the inert gas. The flow rate of the inert gas injected into the dispersion is preferably controlled within a range of 0.05 to 4 L/(hr·kg). The flow rate of the inert gas is more preferably 0.5 to 3.5 L/(hr·kg). The flow rate of the inert gas is a flow rate per kg of the resin (or the polymerizable monomer composition used) contained in the dispersion. From the viewpoint of the efficiency of the stripping treatment and preventing the colored resin particles from aggregation or fusion, it is preferable to control both the temperature and flow rate of the inert gas within the above ranges.

A major characteristic of the present invention is that the diethylbenzene content in the colored resin particles after the stripping step is set to 30 to 250 ppm by the stripping step, and the content of the monovinyl monomer in the colored resin particles after the stripping step is set to 30 ppm or less by the stripping step. When the diethylbenzene content is less than 30 ppm, the low-temperature fixability of the toner thus obtained may be poor. On the other hand, when the diethylbenzene content is more than 250 ppm or the monovinyl monomer content is more than 30 ppm, there is a possibility that an odor generated from the toner thus obtained cannot be prevented upon fixing.

The diethylbenzene content in the colored resin particles after the stripping step is preferably set to 40 to 150 ppm, more preferably 50 to 100 ppm.

The content of the monovinyl monomer in the colored resin particles after the stripping step is preferably set to 10 ppm or less, more preferably 0.01 to 5 ppm.

In the case of using a peroxy ester represented by the following formula (1) as the polymerization initiator, it is preferable that the content of an ether component in the colored resin particles obtained after the stripping step, which is produced by decomposition of the peroxy ester, is set to 30 ppm or less by the stripping step. When the ether component content is more than 30 ppm, there is a possibility that an odor generated from the toner thus obtained cannot be prevented upon fixing.

The content of the ether component in the colored resin particles after the stripping step is more preferably set to 20 ppm or less, still more preferably 0.01 to 10 ppm.

In the present invention, "ether component" refers to overall ether resulting from decomposition, decarboxylation and then recombination of peroxy ester represented by the above formula (1). Due to decomposition, decarboxylation and then recombination of the peroxy ester in the polymerization step, there is a possibility that at least any one of ethers represented by the following formulae (2a) to (2c) is produced:

Formula (2a)

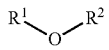

Formula (2b)

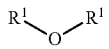

-continued

Formula (2c)

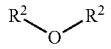

wherein $R^1$ is a secondary alkyl group having 5 or less carbon atoms, and $R^2$ is a t-butyl group or t-hexyl group.

For example, in the case of using one kind of peroxy ester represented by the above formula (1), at least any one of three kinds of ethers represented by the formulae (2a) to (2c) may be produced. Therefore, the content of the ether component is the sum of the contents of the three or less kinds of ethers. In the case of using two or more kinds of peroxy esters as the polymerization initiator, similarly, the content of the ether component is the sum of the contents of multiple kinds of ethers.

Quantitative measurement of the ether component is carried out as follows, for example. First, a standard sample of the ether component is obtained, the ether component corresponding to a by-product occurred by the decomposition of peroxy ester used as the polymerization initiator. As needed, the standard sample is synthesized by a known method. Next, the standard sample is analyzed with an analyzer using gas chromatography mass spectroscopy (GC-MS) or the like to obtain a fragment pattern of the standard sample. Then, the toner is appropriately dissolved in acid or the like. The resulting solution is measured by the analyzer for quantitative measurement of the ether component in the toner.

1-5. Washing, Filtering, Dehydrating and Drying Steps

After the stripping, the aqueous dispersion of the colored resin particles subjected to the stripping, are preferably subjected to repeated cycles of filtering, washing (for removal of the dispersion stabilizer), dehydrating and drying, as needed, according to a known method.

Washing is preferably carried out by the following method: in the case of using an inorganic compound as the dispersion stabilizer, by adding an acid or alkali to the aqueous dispersion, the dispersion stabilizer is dissolved in water and then removed. In the case of using a colloid of a hardly water-soluble inorganic hydroxide as the dispersion stabilizer, it is preferable to add an acid to adjust the pH of the aqueous dispersion to pH 6.5 or less. As the acid added, there may be used inorganic acids such as sulfuric acid, hydrochloric acid and nitric acid, and organic acids such as formic acid and acetic acid. Sulfuric acid is particularly preferred, because of large removal efficiency and small pressure on production facilities.

Dehydrating and filtering can be carried out by various kinds of known methods, and the methods are not particularly limited. For example, there may be mentioned a centrifugal filtration method, a vacuum filtration method, a pressure filtration method, etc. Drying can be also carried out by various kinds of methods, and the methods are not particularly limited.

2. Colored Resin Particles

The colored resin particles are obtained by the above-mentioned wet method (suspension polymerization method).

Hereinafter, the colored resin particles that constitute the toner will be described. The colored resin particles described below encompass both core-shell colored resin particles and other types of colored resin particles.

The colored resin particles preferably have a volume average particle diameter (Dv) of 4 to 12 μm, more preferably 5 to 10 μm. When the Dv is less than 4 μm, toner flowability is decreased and may result in poor transferability or decrease in image density. When the Dv is more than 12 μm, image resolution may be decreased.

As for the colored resin particles, the ratio (Dv/Dn) of the volume average particle diameter (Dv) to the number average particle diameter (Dn) is preferably 1.0 to 1.3, more preferably 1.0 to 1.2. When the Dv/Dn is more than 1.3, there may be a decrease in transferability, image density and resolution. The volume and number average particle diameters of the colored resin particles can be measured by a particle size analyzer (product name: Multisizer; manufactured by: Beckman Coulter, Inc.), for example.

From the viewpoint of image reproducibility, the colored resin particles of the present invention preferably have an average circularity of 0.96 to 1.00, more preferably 0.97 to 1.00, still more preferably 0.98 to 1.00.

When the colored resin particles have an average circularity of less than 0.96, thin line reproducibility may be deteriorated.

In the present invention, "circularity" is defined as a value which is obtained by dividing the perimeter of a circle having the same area as the projected area of a particle image by the perimeter of a particle image. Also in the present invention, "average circularity" is used as a simple method for quantitatively describing the form of the particles and is an indicator that shows the degree of the surface roughness of the colored resin particles. The average circularity is 1 when the colored resin particles are perfectly spherical, and it gets smaller as the surface shape of the colored resin particles becomes more complex.

3. Toner Production Method

In the present invention, preferably, an external additive is attached to the surface of the colored resin particles by mixing the colored resin particles with the external additive and agitating them, thus obtaining a one-component toner (developer). The one-component toner can be further mixed with carrier particles and agitated to obtain a two-component developer.

The agitator used for the attachment is not particularly limited, as long as it is an agitator that is able to attach the external additive to the surface of the colored resin particles. The attachment can be carried out by an agitator that is capable of mixing and agitating, such as Henschel Mixer (product name; manufactured by: Mitsui Mining Co., Ltd.), FM Mixer (product name; manufactured by: Nippon Coke & Engineering Co., Ltd.), Super Mixer (product name; manufactured by: Kawata Mfg. Co., Ltd.), Q Mixer (product name; manufactured by: Nippon Coke & Engineering Co., Ltd.), Mechanofusion system (product name; manufactured by: Hosokawa Micron Corporation) or Mechanomill (product name; manufactured by: Okada Seiko Co., Ltd.)

As the external additive, there may be mentioned inorganic fine particles of silica, titanium oxide, aluminum oxide, zinc oxide, tin oxide, calcium carbonate, calcium phosphate, cerium oxide and so on, and organic particles of polymethyl methacrylate resin, silicone resin, melamine resin and so on. Of them, preferred are inorganic fine particles. Of inorganic fine particles, preferred are inorganic fine particles of silica and titanium oxide, and particularly preferred are inorganic fine particles of silica.

These external additives can be used alone or in combination of two or more kinds. It is particularly preferable to use two or more kinds of silica particles having different particle diameters.

In the present invention, the external additive is generally used in an amount of 0.05 to 6 parts by mass, preferably 0.2 to 5 parts by mass, relative to 100 parts by mass of the colored resin particles. When the amount of the external additive added is less than 0.05 part by mass, toner transferability may lower. When the amount of the external additive added is more than 6 parts by mass, fog may be produced.

4. Toner of the Present Invention

The toner of the present invention is a toner having excellent low-temperature fixability and containing low amounts of residual low-molecular-weight components, which may be a cause of an odor generated upon printing.

EXAMPLES

Hereinafter, the present invention will be described in more detail, by way of examples and comparative examples. However, the present invention is not limited to the examples. All designations of part(s) and % are expressed on mass basis, unless otherwise noted.

Test methods carried out on Examples and Comparative Examples are as follows.

1. Production of Toner for Developing Electrostatic Images

Example 1

The following raw materials were mixed and agitated by an agitator. Then, the mixture was uniformly dispersed by a media type dispersing machine.

- Monovinyl monomer: 75 Parts of styrene and 25 parts of n-butyl acrylate (The thus-obtained copolymer has a Tg of 44° C.)
- Black colorant: 7 Parts of carbon black (product name: #25; manufactured by: Mitsubishi Chemical Corporation)
- Positively-chargeable charge control agent: 0.5 Part of a positively-chargeable charge control resin (a quaternary ammonium base-containing copolymer (product name: FCA-161P; manufactured by: Fujikura Kasei Co., Ltd.; a styrene acrylic resin containing 8% by mass of a quaternary ammonium base-containing (meth) acrylate monomer unit; Tg: 60° C.; Mw: 21,000))
- 0.25 Part of a polymethacrylic acid ester macromonomer (product name: AA6; manufactured by: TOAGOSEI Co., Ltd.; Tg: 94° C.)

The following raw material was added to the mixture, mixed and dissolved, thus obtaining a polymerizable monomer composition.

- Release agent: 5 Parts of dipentaerythritol hexamyristate (solubility in styrene: 10 g or more/100 g, endothermic peak 65° C., molecular weight 1,514)

An aqueous solution of 7.28 parts of sodium hydroxide (alkali metal hydroxide) dissolved in 50 parts of ion-exchange water, was gradually added, with agitation, to an aqueous solution of 12.9 parts of magnesium chloride (water-soluble polyvalent metal salt) dissolved in 250 parts of ion-exchange water, thus preparing a magnesium hydroxide colloid dispersion (hardly water-soluble metal hydroxide colloid dispersion).

To the magnesium hydroxide colloid dispersion obtained above, the polymerizable monomer composition was added at room temperature and agitated until the droplets became stable. To the resultant, the following raw materials were added:

- Polymerization initiator: 5 Parts of t-butylperoxy-2-ethylbutanoate (product name: Trigonox 27; manufactured by: Akzo Nobel; purity: 98%; molecular weight: 188; one-hour half-life temperature: 94° C.)
- Molecular weight modifier: 1.2 Parts of t-dodecyl mercaptan
- Cross-linkable polymerizable monomer: 1.0 Part of divinylbenzene A (product name: DVB570; manufactured by: Nippon Steel Chemical Co., Ltd.; divinylbenzene purity: 57%; diethylbenzene content ratio: 4.3%)

Then, the mixture was subjected to high shear agitation with an in-line emulsification device (product name: Ebara Milder; manufactured by: Ebara Corporation) at a rotational frequency of 15,000 rpm for 10 minutes, thus forming droplets of the polymerizable monomer composition.

The thus-obtained suspension in which the droplets of the polymerizable monomer composition were dispersed (polymerizable monomer composition dispersion) was put in a reactor furnished with agitating blades. The reactor temperature was increased to 90° C. to initiate polymerization reaction. When the polymerization conversion rate reached 95%, the following raw materials were added thereto.

- Polymerizable monomer for shell: 1 Part of methyl methacrylate
- Polymerization initiator for shell: 0.1 Part of 2,2'-azobis (2-methyl-N-(2-hydroxyethyl)-propionamide) (product name: VA-086; manufactured by: Wako Pure Chemical Industries, Ltd.) dissolved in 10 parts of ion-exchange water The reaction was kept at 90° C. for 3 hours and stopped, thus obtaining an aqueous dispersion of core-shell colored resin particles having a pH of 9.5. Part of the aqueous dispersion was taken out, cooled to room temperature, and then mixed with sulfuric acid to dissolve magnesium hydroxide therein, which was used as the dispersion stabilizer. The resultant was filtered to separate the colored resin particles therefrom. Thereafter, the colored resin particles were repeatedly washed and filtered with ion-exchange water, thus obtaining the colored resin particles in a wet state. After calculating the moisture content in the colored resin particles, the remaining styrene amount, remaining ether component amount and remaining diethylbenzene amount in the colored resin particles were measured by the methods described below. The measurement results are shown in Table 1.

Stripping treatment was carried out as follows on the aqueous dispersion of the colored resin particles, by the inert gas injection method and in the stripping treatment system shown in FIG. 1.

First, the aqueous dispersion of the colored resin particles (hereinafter referred to as aqueous dispersion 4) was diluted with ion-exchange water to a solid concentration of 20% and then supplied to an evaporator 1. Then, 0.1 part of a defoaming agent (product name: SN Defoamer 180; manufactured by: San Nopco Limited) was put in the evaporator 1. Nitrogen gas was injected into the evaporator 1 to replace the gas phase part inside the evaporator with the nitrogen gas.

Next, while being agitated with an agitator 3, the aqueous dispersion 4 was heated to 80° C., the agitator being furnished with agitating blades. Then, a blower 6 was started to inject the nitrogen gas through a gas intake tube 5 into the aqueous dispersion 4, the tube having a gas intake part in a straight tube form, thereby removing volatile substances from the colored resin particles.

After the stripping treatment, the nitrogen gas passed through a gas circulation line 7 and was introduced to a condenser 8 and then to a condensation tank 9 for condensation. The condensed nitrogen gas passed through a gas circulation line 10 and was introduced to a volatile substance removal device (an adsorption tower filled with activated carbon) 11 to remove volatile substances from the nitrogen gas. The volatile substance-free nitrogen gas passed through a gas circulation line 12 and was injected into the evaporator 1 again, through the blower 6 and then through a gas circulation line 13.

The stripping treatment was carried out in the following condition.

Temperature of the aqueous dispersion 4: 85° C.

Pressure inside the evaporator 1: 60 kPa

Flow rate of the nitrogen gas at 75° C.: 3 L/(hr·kg)

Treatment time: 6 Hours

After the six hours of treatment, the aqueous dispersion 4 was cooled to room temperature.

Thereafter, acid washing was carried out on the aqueous dispersion 4, in which sulfuric acid was added to the aqueous dispersion to adjust the pH of the aqueous dispersion to 6.5 or less, while agitating the aqueous dispersion at room temperature. Then, water washing was carried out thereon, in which water was separated from the aqueous dispersion 4 by filtration, followed by addition of another 500 parts of ion-exchange water to turn the dispersion into a slurry again. Thereafter, dehydration and the water washing were further carried out on the thus-obtained dispersion slurry repeatedly several times. After the colored resin particles were separated by filtration, the separated particles were dried at 40° C. for two days.

The thus-obtained colored resin particles had a volume average particle diameter (Dv) of 7.5 μm, a particle size distribution (Dv/Dn) of 1.13, and an average circularity of 0.976. The remaining styrene amount, remaining ether component amount and remaining diethylbenzene amount in the colored resin particles were measured by the methods described below. The measurement results are shown in Table 1.

To 100 parts of the colored resin particles obtained, 0.6 part of hydrophobized fine silica particles (product name: TG820F; manufactured by: Cabot Corporation) and 1.0 part of hydrophobized fine silica particles (product name: NA50Y; manufactured by: Nippon Aerosil Co., Ltd.) were added and mixed with a high-speed agitator (product name: Henschel Mixer; manufactured by: Mitsui Mining Co., Ltd.), thus producing a toner for developing electrostatic images of Example 1, which is a non-magnetic one-component toner. The toner was used in the tests mentioned below.

Example 2

A toner for developing electrostatic images of Example 2 was produced in the same manner as Example 1, for use in tests, except that as to the cross-linkable polymerizable monomer, the amount of the divinylbenzene A added (product name: DVB570; manufactured by: Nippon Steel Chemical Co., Ltd.; divinylbenzene purity: 57%; diethylbenzene content ratio: 4.3%) was changed to 0.5 part from 1.0 part, and 0.3 part of divinylbenzene B (product name: DVB960; manufactured by: Nippon Steel Chemical Co., Ltd.; divinylbenzene purity: 96%; diethylbenzene content ratio: 0.2%) was further used.

Comparative Example 1

A toner for developing electrostatic images of Comparative Example 1 was produced in the same manner as Example 1, for use in tests, except that in the stripping treatment, the temperature of the aqueous dispersion of the colored resin particles was changed to 70° C. from 85° C.

Comparative Example 2

A toner for developing electrostatic images of Comparative Example 2 was produced in the same manner as Example 1, for use in tests, except that as to the cross-linkable polymerizable monomer, the amount of the divinylbenzene A added (product name: DVB570; manufactured by: Nippon Steel Chemical Co., Ltd.; divinylbenzene purity: 57%; diethylbenzene content ratio: 4.3%) was changed to 0.5 part from 1.0 part, and 0.3 part of the divinylbenzene B (product name: DVB960; manufactured by: Nippon Steel Chemical Co., Ltd.; divinylbenzene purity: 96%; diethylbenzene content ratio: 0.2%) was further used; moreover, the stripping treatment time was changed to 3 hours from 6 hours.

Comparative Example 3

A toner for developing electrostatic images of Comparative Example 3 was produced in the same manner as Example 1, for use in tests, except that the stripping treatment time was changed to 12 hours from 6 hours.

Comparative Example 4

A toner for developing electrostatic images of Comparative Example 4 was produced in the same manner as Example 1, for use in tests, except that as to the cross-linkable polymerizable monomer, 1.0 part of the divinylbenzene A (product name: DVB570; manufactured by: Nippon Steel Chemical Co., Ltd.; divinylbenzene purity: 57%; diethylbenzene content ratio: 4.3%) was changed to 0.6 part of the divinylbenzene B (product name: DVB960; manufactured by: Nippon Steel Chemical Co., Ltd.; divinylbenzene purity: 96%; diethylbenzene content ratio: 0.2%), and in the stripping treatment, the temperature of the aqueous dispersion of the colored resin particles was changed to 70° C. from 85° C.

2. Evaluation of Toners for Developing Electrostatic Images

The toners of Examples 1 and 2 and Comparative Examples 1 to 4 were evaluated for their properties. Details are as follows.

2-1. Measurement of Volume Average Particle Diameter (Dv) and Number Average Particle Diameter (Dn) of Colored Resin Particles, and Calculation of Particle Size Distribution (Dv/Dn) of the Same Approximately 0.1 g of the measurement sample (colored resin particles) was put in a beaker. An alkylbenzene sulfonic acid aqueous solution (product name: Driwel; manufactured by: Fujifilm Corporation) of 0.1 mL was added thereto, which serves as a dispersant. In addition, 10 to 30 mL of Isoton II was put in the beaker. The mixture was dispersed for 3 minutes with a 20 W (watt) ultrasonic disperser. Then, the volume average particle diameter (Dv) and number average particle diameter (Dn) of the colored resin particles were measured with a particle diameter measuring device (product name: Multisizer; manufactured by: Beckman Coulter, Inc.) in the following condition, followed by calculation of the particle size distribution (Dv/Dn).

Aperture diameter: 100 μm

Medium: Isoton II

Number of measured particles: 100,000 particles 2-2. Average Circularity of Colored Resin Particles First, 10 mL of ion-exchange water was put in a container. Then, 0.02 g of a surfactant (alkylbenzene sulfonic acid) was added thereto, which serves as a dispersant. In addition, 0.02 g of the measurement sample (colored resin particles) was added thereto. The mixture was subjected to dispersion treatment for 3 minutes with a ultrasonic disperser at 60 W (watt). The resultant was adjusted so as to have a colored resin particle concentration of 3,000 to 10,000 particles/μL at the time of measurement. Of the colored resin particles, 1,000-10,000 particles of 0.4 μm or more by a diameter of the equivalent circle were measured with a flow particle image analyzer (product name: FPIA-2100; manufactured by: Sysmex Corporation). The average circularity was obtained from the measured values.

The circularity is expressed by the following calculation formula 1. The average circularity is the average of circularities measured by the calculation formula 1.

(Circularity)=(The perimeter of a circle having the same area as the projected area of a particle image)/(The perimeter of a particle image) Calculation Formula 1:

2-3. Measurement of Remaining Styrene Amount, Remaining Ether Component Amount and Remaining Diethylbenzene Amount The remaining styrene amount, remaining ether component amount and remaining diethylbenzene amount in the colored resin particles after the polymerization step and before the stripping step, were measured. Also, those of the colored resin particles after the stripping step were measured.

One gram of the colored resin particles was weighed as precisely as possible and then immersed in ethyl acetate. The colored resin particles were dissolved with agitation to extract a low-molecular-weight component. Then, methanol was added thereto to precipitate a binder resin component. Thereafter, the binder resin component was removed by filtration to separate an extraction liquid containing the low-molecular-weight component contained in the colored resin particles. The extraction liquid thus separated was measured in the following condition by the GC-MS method.

(GC-MS Measurement Condition)

Gas chromatograph: Agilent 6890N

Mass spectrometer: Agilent 5973 inert

Column: DB1701 (Inner diameter 0.25 mm×Length 30 m, df=1.0 μm)

Column temperature: Increased from 100° C. to 280° C. at a heating rate of 10° C./min Injection temperature: 320° C.

Split ratio: 50:1

Injected amount: 1 μL

Helium flow rate: 1 mL/min

Detector: MSD 2-4. Evaluation of Minimum Fixing Temperature

A commercially-available, non-magnetic one-component development printer (printing rate=32 sheets/min) was used, which had been modified to be able to change the temperature of a fixing roller. The toner cartridge inside the development device of the printer was filled with 100 g of the toner. Then, printing sheets were set in the printer, and a fixing test was carried out as follows.

In the fixing test, the temperature of the fixing roller of the modified printer was decreased by 5° C. from 200° C. to a low-temperature range, and every time the temperature was decreased, a solid pattern with 100% printing image density was printed to measure toner fixing rate and to obtain the relationship between temperature and toner fixing rate.

Every time the temperature was decreased, the new temperature was maintained for 5 minutes or more to stabilize the temperature of the fixing roller.

The toner fixing rate was obtained as follows: in the printing area of the solid pattern (with 100% printing image density), tape removal was carried out, and the toner fixing rate was calculated from the ratio of image densities before and after the tape removal. More specifically, when the image density before the tape removal is referred to as "ID(before)" and the image density after the tape removal is referred to as "ID(after)", the toner fixing rate can be calculated by the following calculation formula 2:

Fixing rate(%)=(ID(after)/ID(before))×100 Calculation formula 2:

In particular, the tape removal is an operation comprising the steps of: attaching a piece of adhesive tape (product name: Scotch Mending Tape 810-3-18; manufactured by: Sumitomo 3M Limited) to a measurement part of a test sheet; firmly attaching the piece of the adhesive tape by pressing the piece at a given pressure with a metal roller disk (diameter 15 cm, thickness 2 cm, weight 1 kg); and then removing the piece of the adhesive tape at a constant speed in a direction along the sheet. Image density was measured with a reflection image densitometer (product name: RD914; manufactured by: McBeth).

In this fixing test, the minimum fixing roller temperature at which the toner fixing rate was 80% or more, was referred to as the minimum fixing temperature of the toner.

2-5. Odor Evaluation

In the above-mentioned minimum fixing temperature evaluation, when the fixing temperature was set to 180° C., sensory evaluation of an odor around a paper output slot was carried out by five healthy people, which was generated from the monomer, etc. The evaluation criterion is as follows.

○: All of the five people did not feel the odor generated from the monomer.

Δ: One or two of the five people felt the odor generated from the monomer.

x: Three or more of the five people felt the odor generated from the monomer.

Measurement and evaluation results of the toners for developing electrostatic images of Examples 1 and 2 and Comparative Examples 1 to 4, are shown in Table 1, along with the type and amount of the divinylbenzenes used. In Table 1, rows titled "GCMS measurement after polymerization" show the GCMS measurement results of the colored resin particles after the polymerization step and before the stripping step, while rows titled "GCMS measurement of toner" show the GCMS measurement results of the colored resin particles after the stripping step.

TABLE 1

| | | Example 1 | Example 2 | Comparative Example 1 | Comparative Example 2 | Comparative Example 3 | Comparative Example 4 |
|---|---|---|---|---|---|---|---|
| Type of divinylbenzenes used | Amount of divinylbenzene A added (part) | 1.0 | 0.5 | 1.0 | 0.5 | 1.0 | 0.0 |
| | Amount of divinylbenzene B added (part) | 0.0 | 0.3 | 0.0 | 0.3 | 0.0 | 0.6 |

TABLE 1-continued

| | | Example 1 | Example 2 | Comparative Example 1 | Comparative Example 2 | Comparative Example 3 | Comparative Example 4 |
|---|---|---|---|---|---|---|---|
| GCMS measurement after polymerization | Remaining styrene amount (ppm) | 1500 | 1480 | 1510 | 1500 | 1490 | 1510 |
| | Remaining ether component amount (ppm) | 3000 | 2980 | 3050 | 3020 | 2960 | 3040 |
| | Diethylbenzene amount (ppm) | 320 | 174 | 325 | 174 | 336 | 5 |
| Stripping treatment condition | Defoaming agent (part) | 0.1 | 0.1 | 0.1 | 0.1 | 0.1 | 0.1 |
| | Treatment liquid temperature (° C.) | 85 | 85 | 70 | 85 | 85 | 70 |
| | Pressure applied to gas phase part (kPa) | 60 | 60 | 60 | 60 | 60 | 60 |
| | N2 flow rate L/(hr · kg) | 3 | 3 | 3 | 3 | 3 | 3 |
| | Treatment time (hr) | 6 | 6 | 6 | 3 | 12 | 6 |
| GCMS measurement of toner | Remaining styrene amount (ppm) | 3 | 4 | 10 | 45 | 1 | 12 |
| | Remaining ether component amount (ppm) | 8 | 9 | 18 | 90 | 2 | 19 |
| | Diethylbenzene amount (ppm) | 80 | 55 | 300 | 123 | 10 | 3 |
| Evaluation of toner properties | Minimum fixing temperature (° C.) | 160 | 160 | 150 | 155 | 170 | 170 |
| | Odor evaluation | ○ | ○ | X | X | ○ | ○ |

3. Evaluation of Toners

Hereinafter, the evaluation results of the toners for developing electrostatic images will be studied, with reference to Table 1.

According to Table 1, the toner of Comparative Example 1 is a toner obtained by adding 1.0 part of the divinylbenzene A and through the stripping treatment in which the temperature of the aqueous dispersion of the colored resin particles was set to 70° C. According to Table 1, the minimum fixing temperature of the toner of Comparative Example 1 is 150° C. Therefore, there is no problem with at least the low-temperature fixability.

However, the diethylbenzene amount of the toner of Comparative Example 1 after the stripping treatment, is as high as 300 ppm. Also, the toner of Comparative Example 1 is a toner for which three or more of the five people felt the odor generated from the monomer in the odor evaluation. Therefore, it is clear that the toner of Comparative Example 1, which was obtained by using the divinylbenzene A having a divinylbenzene purity of 57% and through the stripping treatment in which the temperature of the aqueous dispersion of the colored resin particles was as low as less than 80° C., has an odor problem because a large amount of diethylbenzene, which is an impurity, remained in the toner.

According to Table 1, the toner of Comparative Example 2 is a toner obtained by adding 0.5 part of the divinylbenzene A and 0.3 part of the divinylbenzene B, and through the stripping treatment for 3 hours. According to Table 1, the minimum fixing temperature of the toner of Comparative Example 2 is 155° C. Therefore, there is no problem with at least the low-temperature fixability.

However, the remaining styrene amount and remaining ether component amount in the toner of Comparative Example 2 after the stripping treatment, are as high as 45 ppm and 90 ppm, respectively. Also, the toner of Comparative Example 2 is a toner for which three or more of the five people felt the odor generated from the monomer in the odor evaluation. Therefore, it is clear that the toner of Comparative Example 2, which was obtained by using the divinylbenzene A having a divinylbenzene purity of 57% in combination with the divinylbenzene B having a divinylbenzene purity of 96% and through the stripping treatment for less than 4 hours, has an odor problem because large amounts of styrene and ether component, which are impurities, remained in the toner.

According to Table 1, the toner of Comparative Example 3 is a toner obtained by adding 1.0 part of the divinylbenzene A and through the stripping treatment for 12 hours. According to Table 1, the toner of Comparative Example 3 is a toner for which all of the five people did not feel the odor generated from the monomer in the odor evaluation. Therefore, the toner does not have at least an odor problem.

However, the minimum fixing temperature of the toner of Comparative Example 3 is as high as 170° C. Therefore, it is clear that the toner of Comparative Example 3, which was obtained by using the divinylbenzene A having a divinylbenzene purity of 57% and through the stripping treatment for more than 8 hours, is inferior in low-temperature fixability.

According to Table 1, the toner of Comparative Example 4 is a toner obtained by adding 0.6 part of the divinylbenzene B and through the stripping treatment in which the temperature of the aqueous dispersion of the colored resin particles was set to 70° C. According to Table 1, the toner of Comparative Example 4 is a toner for which all of the five people did not feel the odor generated from the monomer in the odor evaluation. Therefore, the toner does not have at least an odor problem.

However, the minimum fixing temperature of the toner of Comparative Example 4 is as low as 170° C. Therefore, it is clear that the toner of Comparative Example 4, which was obtained by using the divinylbenzene B having a divinylbenzene purity of 96% and through the stripping treatment in which the temperature of the aqueous dispersion of the colored resin particles was as low as less than 80° C., is inferior in low-temperature fixability, even if the stripping condition is relaxed, because the diethylbenzene amount after the polymerization and before the stripping is as low as less than 30 ppm.

According to Table 1, the toner of Example 1 is such a toner that the diethylbenzene amount after the polymerization and before the stripping is 320 ppm; the diethylbenzene amount after the stripping is 80 ppm; and the remaining styrene amount is 3 ppm. The toner of Example 2 is such a toner that the diethylbenzene amount after the polymerization and before the stripping is 174 ppm; the diethylbenzene amount after the stripping is 55 ppm; and the remaining styrene amount is 4 Ppm.

According to Table 1, the minimum fixing temperatures of the toners of Examples 1 and 2 are 160° C. each, so that there is no problem with the low-temperature fixability. Also, the toners of Examples 1 and 2 are toners for which all of the five people did not feel the odor generated from the monomer in the odor evaluation, so that the toners do not have an odor problem.

Therefore, it is clear that the toners of Example 1 and 2, which are such toners that the diethylbenzene content in the colored resin particles after the polymerization and before the stripping is 100 to 400 ppm; the diethylbenzene content in the colored resin particles after the stripping is 30 to 250 ppm; and the monovinyl monomer content is 30 ppm or less, are toners which have excellent low-temperature fixability and which do not cause odor problem upon fixing.

REFERENCE SIGNS LIST

1. Evaporator
2. Jacket
3. Agitator furnished with agitating blades
4. Aqueous dispersion of colored resin particles
5. Gas intake tube
6. Blower
7. Gas circulation line
8. Condenser
9. Condensation tank
10. Gas circulation line
11. Volatile substance removal device
12. Gas circulation line
13. Gas circulation line
14. Non-contact foam level meter

The invention claimed is:

1. A method for producing a toner for developing electrostatic images, wherein the method comprises:

a polymerization step in which a polymerizable monomer composition containing at least one monovinyl monomer selected from the group consisting of styrene and a styrene derivative, a cross-linkable divinyl monomer consisting of divinylbenzene, and a colorant, is polymerized in an aqueous medium in the presence of a polymerization initiator to produce colored resin particles, and a stripping step in which a volatile substance remaining in the colored resin particles is removed in the aqueous medium;

wherein the polymerizable monomer composition contains diethylbenzene;

wherein a content of diethylbenzene in the colored resin particles after the polymerization step and before the stripping step, is set to 100 to 400 ppm by the polymerization step; and wherein the diethylbenzene content in the colored resin particles after the stripping step is set to 30 to 250 ppm by the stripping step, and a content of the monovinyl monomer in the colored resin particles after the stripping step is set to 30 ppm or less by the stripping step.

2. The method for producing a toner for developing electrostatic images according to claim 1, wherein the polymerization initiator is a peroxy ester represented by the following formula (1), and wherein a content of an ether component in the colored resin particles after the stripping step, which is produced by decomposition of the peroxy ester, is set to 30 ppm or less by the stripping step:

Formula (1)

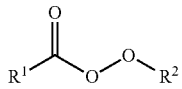

wherein $R^1$ is a secondary alkyl group having 5 or less carbon atoms, and $R^2$ is a t-butyl group or t-hexyl group.

3. The method for producing a toner for developing electrostatic images according to claim 1, wherein the stripping step is carried out for 4 to 8 hours, with injecting gas into an aqueous dispersion containing the colored resin particles, in the condition that a temperature of the aqueous dispersion is set to 80 to 90° C. and a pressure of a gas phase part is set to 50 to 70 kPa.

4. A toner for developing electrostatic images, wherein the toner comprises:

colored resin particles containing a binder resin that contains a styrene-based monomer unit and a divinylbenzene-based monomer unit, and a colorant, and an external additive, and wherein a content of diethylbenzene in the colored resin particles is 30 to 250 ppm, and a content of styrene in the colored resin particles is 30 ppm or less.

5. The toner for developing electrostatic images according to claim 4, wherein the binder resin is a resin obtained by polymerization in the presence of a peroxy ester represented by the following formula (1), and wherein a content of an ether component in the colored resin particles, which is produced by decomposition of the peroxy ester, is 30 ppm or less:

Formula (1)

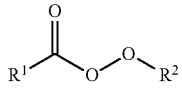

wherein $R^1$ is a secondary alkyl group having 5 or less carbon atoms, and $R^2$ is a t-butyl group or t-hexyl group.

6. The method for producing a toner for developing electrostatic images according to claim 2, wherein the stripping step is carried out for 4 to 8 hours, with injecting gas into an aqueous dispersion containing the colored resin particles, in the condition that a temperature of the aqueous dispersion is set to 80 to 90° C. and a pressure of a gas phase part is set to 50 to 70 kPa.

7. The method for producing a toner for developing electrostatic images according to claim 1, wherein the content of the monovinyl monomer in the colored resin particles after the stripping step is set to 0.01 ppm to 30 ppm by the stripping step.

8. The method for producing a toner for developing electrostatic images according to claim 1, wherein the diethylbenzene content in the colored resin particles after the stripping step is set to 30 to 150 ppm by the stripping step.

* * * * *